US011438693B2

(12) United States Patent
Hsieh

(10) Patent No.: US 11,438,693 B2
(45) **Date of Patent: *Sep. 6, 2022**

(54) FOOTSTEPS TRACKING METHOD AND SYSTEM THEREOF

(71) Applicant: Nanning FuLian FuGui Precision Industrial Co., Ltd., Nanning (CN)

(72) Inventor: Chih-Feng Hsieh, New Taipei (TW)

(73) Assignee: Nanning FuLian FuGui Precision Industrial Co., Ltd., Nanning (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/376,400

(22) Filed: Jul. 15, 2021

(65) Prior Publication Data

US 2022/0070578 A1 Mar. 3, 2022

Related U.S. Application Data

(63) Continuation of application No. 17/007,408, filed on Aug. 31, 2020, now Pat. No. 11,122,364.

(51) Int. Cl.
*H04R 1/40* (2006.01)
*H04R 3/00* (2006.01)

(52) U.S. Cl.
CPC ..... *H04R 1/406* (2013.01); *H04R 3/005* (2013.01)

(58) Field of Classification Search
CPC ..... H04R 1/406; H04R 3/005
USPC ..... 381/92, 300, 307, 26, 93, 94.1
See application file for complete search history.

(56) References Cited

U.S. PATENT DOCUMENTS

| | | | | |
|---|---|---|---|---|
| 10,412,532 | B2 * | 9/2019 | Pearson | H04R 5/04 |
| 2016/0011851 | A1 * | 1/2016 | Zhang | H04R 3/12 381/56 |
| 2018/0343517 | A1 * | 11/2018 | Usher | H04R 3/005 |

* cited by examiner

*Primary Examiner* — Thjuan K Addy
(74) *Attorney, Agent, or Firm* — ScienBiziP, P.C.

(57) ABSTRACT

A footsteps tracking method, including the steps of: receiving a first sound signal of a user's first footstep; calculating a first position of the first footstep according to relative position relationship of at least three microphones in the microphone array and time differences of sound arrival of the first sound signal received by the three microphones respectively; receiving a second sound signal of a second footstep of the user, wherein an audio frequency of the second sound signal is the same as an audio frequency of the first sound signal; and calculating a second position of the second footstep according to the first position, a time difference between receiving the first sound signal and the second sound signal, receiving angles between the first sound signal and a pair of the three microphones, and receiving angles between the second sound signal and the pair of the three microphones.

8 Claims, 6 Drawing Sheets

FOOTSTEPS TRACKING METHOD AND SYSTEM THEREOF

CROSS REFERENCE TO RELATED APPLICATIONS

This application is a Continuation of pending U.S. patent application Ser. No. 17/007,408, filed on Aug. 31, 2020 and entitled "FOOTSTEPS TRACKING METHOD AND SYSTEM THEREOF", the contents of which are incorporated by reference herein.

FIELD

The invention relates in general to a footsteps tracking method and system thereof, and more particularly to the footsteps tracking method and system for tracking the footstep according to the user's step distance and moving angles after locating the user's first footstep.

BACKGROUND

In the prior art, multiple sensors are usually used to monitor the movement of the user, and at the same time, to collect related data such as the frequency and intensity of the user footsteps, in order to achieve the purpose of tracking the user. However, for accurately monitoring each step of the user, multiple sensors must be arranged in the surrounding environment, which requires a big cost. Therefore, how to achieve the purpose of locating the footsteps of the user at a lower cost is a problem that needs to be solved.

BRIEF DESCRIPTION OF THE DRAWINGS

Implementations of the present technology will now be described, by way of example only, with reference to the attached figures, wherein.

DETAILED DESCRIPTION

Further areas to which the present disclosure can be applied will become apparent from the detailed description provided herein. It should be understood that the detailed description and specific examples, while indicating exemplary embodiments, are intended for purposes of illustration only and are not intended to limit the scope of the claims.

Figure 1:
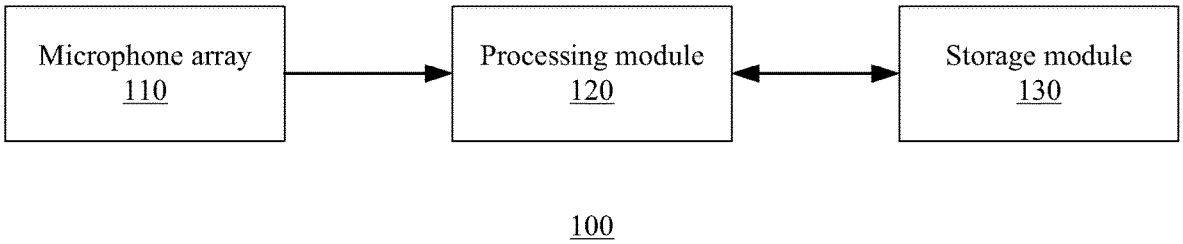
FIG. 1 is a block diagram of a tracking system 100 in accordance with an embodiment of the invention.

FIG. 1 is a block diagram of a tracking system 100 in accordance with an embodiment of the invention. The track tracking system 100 at least includes a microphone array 110, a processing module 120, and a storage module 130. The microphone array 110 is composed of at least three microphones arranged at different positions for receiving sound signals corresponding to different sound sources in various directions. The processing module 120 is configured to receive the sound signals from the microphone array 110, and determine a location of the sound source according to relative position relationship between every two microphones in the microphone array 110, time and angle of receiving the sound signals, and the characteristics of the sound signals. The processing module 120 can be, for example, dedicated hardware circuits or general-purpose hardware (e.g., a single processor, a multi-processor with parallel processing capabilities, a graphics processor, or other computing capabilities processor), and is able to provide the functions described below. The storage module 130 can be a non-volatile storage device such as a hard disk, a flash drive, etc., for storing the position of each microphone in the microphone array 110, the relative position relationship between every two adjacent microphones, and various types of sound frequencies corresponding to different sound sources and various algorithms for calculation process accessed by the processing module 120. In the embodiments of the invention, if the sound sources are the footsteps of a human being, they can be determined whether belong to the same user according to sound frequency of shoes and/or volumes of the footsteps.

Figure 2:
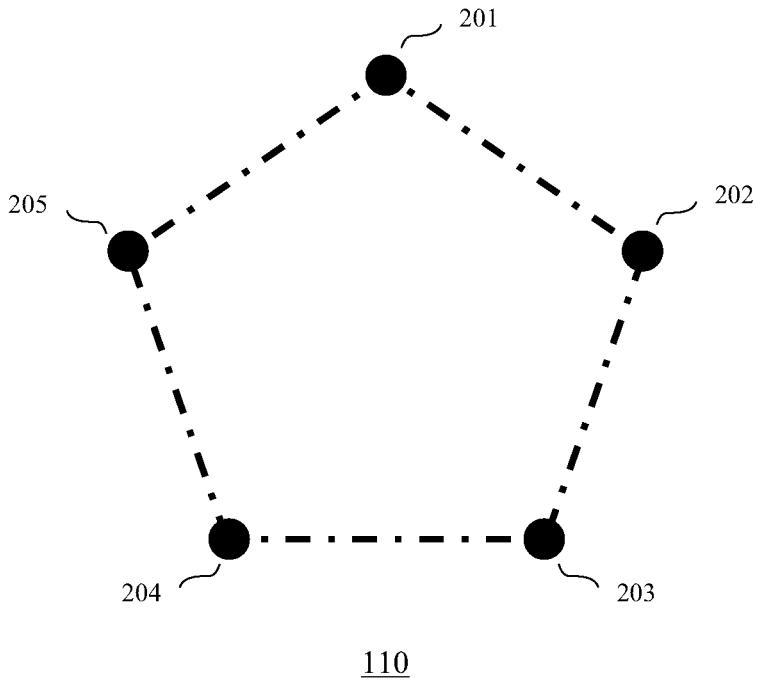
FIG. 2 is a schematic diagram of the microphone array 110 in accordance with an embodiment of the invention.

FIG. 2 is a schematic diagram of the microphone array 110 in accordance with an embodiment of the invention. In the example of the invention, the microphone array 110 is composed of microphones 201-205 and is a regular pentagon. The distance between every two adjacent microphones (i.e. the distances between microphone 201 and microphone 202, microphone 202 and microphone 203, microphone 203 and microphone 204, microphone 204 and microphone 205, and microphone 205 and microphone 201) is 20 mm. It should be noted that the regular pentagon microphone array shown in FIG. 2 is only a preferred embodiment, but it is not limited thereto, and the distance between every two adjacent microphones can also be User-defined.

Figure 3:
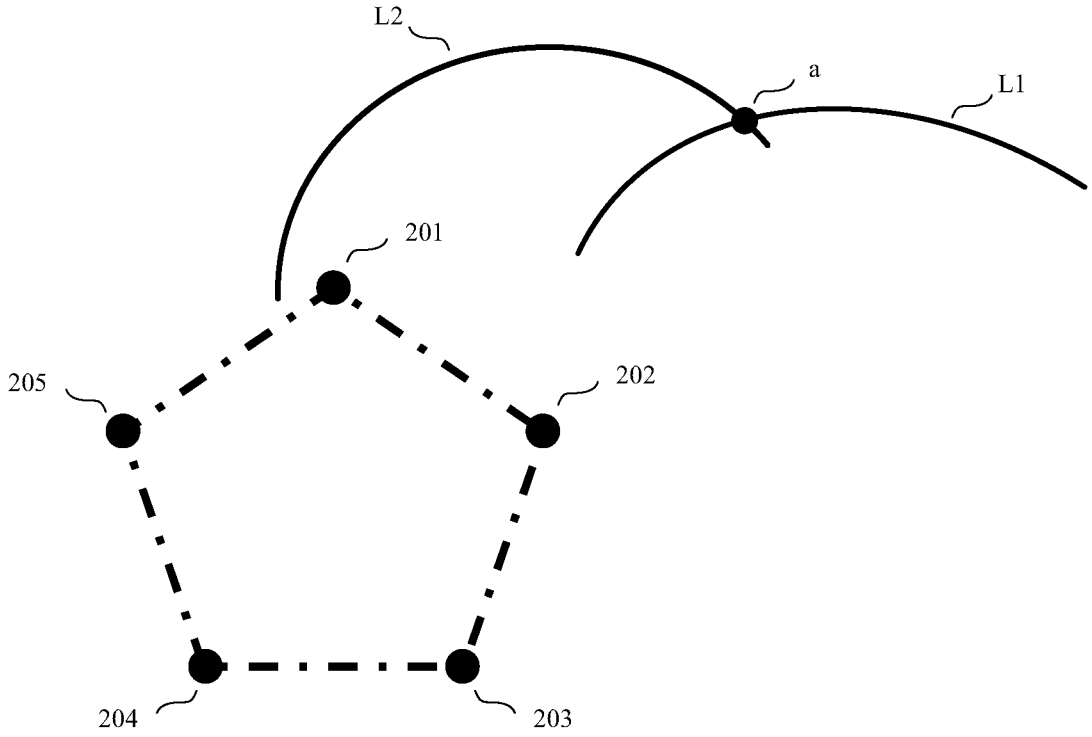
FIG. 3 is a schematic diagram of how to locate the user in accordance with an embodiment of the invention.

FIG. 3 is a schematic diagram of how to locate the user in accordance with an embodiment of the invention. First, when the processing module 120 receives the sound signal corresponding to the user's current footstep through the microphone array 110, analyzes the sound frequency corresponding to the footstep from the sound signal to determine whether the sound frequency of the footstep has existed. When the sound frequency corresponding to the current footstep cannot be found in the storage module 130 within a predetermined time (for example, within the first 5 seconds), the processing module 120 determines that the user has stepped into the sound receiving range of the microphone array 110 for the first time or is standing at a certain point for a long time without moving, and then uses the time difference of arrival (TDOA) positioning algorithm to determine the user's current location. For example, as shown in FIG. 3, when the user's footstep appear at point "a" and the sound frequency corresponding to the footstep does not exist, since the distances between point "a" and microphones 201, 202, and 205 are different, thus the processing module 120 can obtain the hyperbolic "L1" corresponding to the microphones 201, 202 and the hyperbolic "L2" corresponding to the microphones 201, 205 according to the time difference of sound arrival of the sound to the microphones 201, 202, and 205, respectively. The handover point "a" is the position corresponding to the user's current footstep.

Figure 4A:
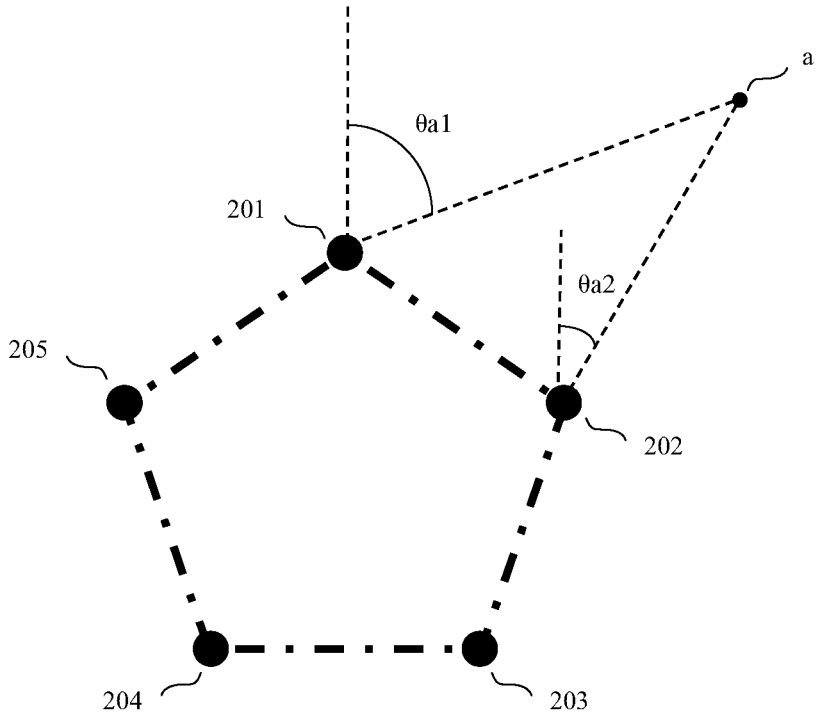
FIGS. 4*a* and 4*b* are schematic diagrams of calculating the position of the second footstep in accordance with an embodiment of the invention.

After calculating the position corresponding to the point "a", the processing module 120 further calculates the receiving angle of the pair of microphones in the microphone array 110 which are closest to the point "a" as a reference for determining the user's subsequent movement. For example, as shown in FIG. 4*a*, after obtaining the position of point "a", the two microphones which are closest to the point "a" are microphones 201 and 202, and the processing module

Figure 4B:
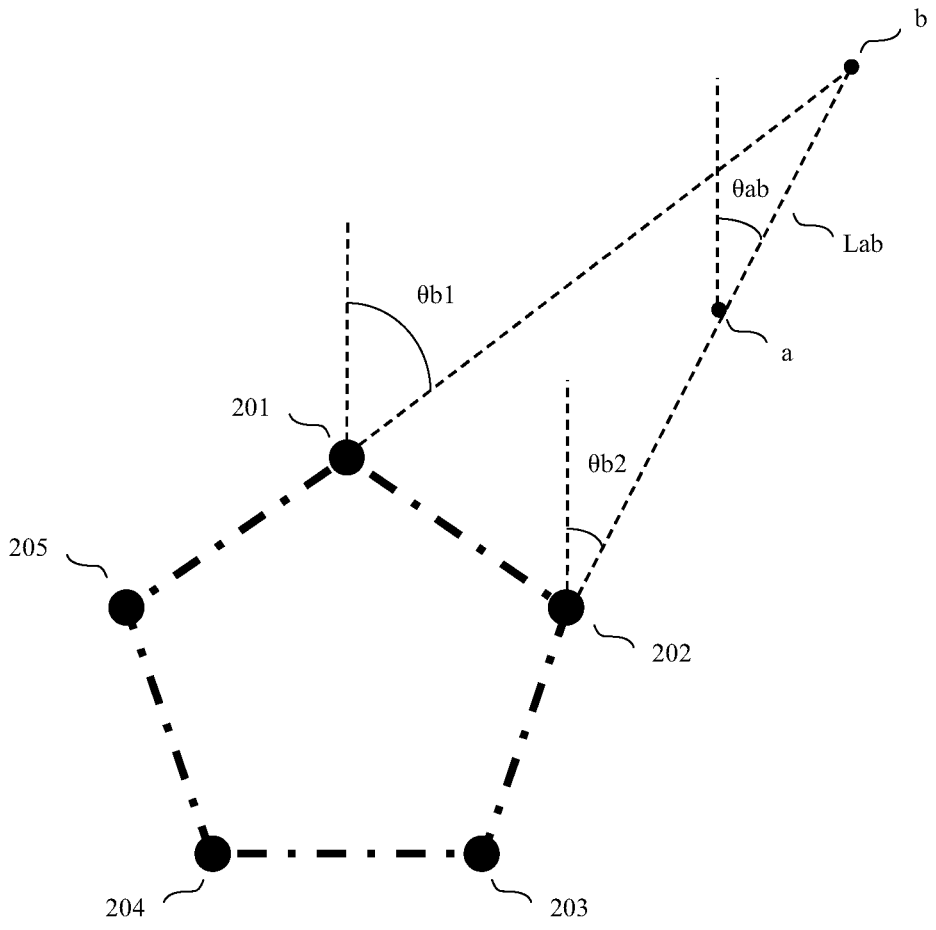

120 then obtains a receiving angle "θa1" corresponding to the microphone 201 and a receiving angle "θa2" corresponding to the microphone 202, and stores the receiving angles "θa1" and "θa2" in the storage module 130. Then, when the processing module 120 receives the sound signal corresponding to the user's next footstep through the microphone array 110 (for example, by determining the sound frequency and/or the volume corresponding to the footstep sound), the processing module 120 further calculates a receiving angle "θb1" of the next footstep corresponding to of the microphone 201 and a receiving angle "θb2" of the next footstep corresponding to the microphone 202 which as shown in FIG. 4*b*. Then, the processing module 120 can determine the user's movement track based on the receiving angles and the step distance. The step distance can be decided according to a time difference between the user's current footstep and the previous footstep. For example, when the time difference is less than 1.5 steps per second, it means that the user is walking at a slower speed, and the corresponding step distance is usually shorter (for example, 70 cm). When the time difference is 1.5-2 steps per second, it means that the user is walking at a normal speed, and the corresponding step distance is about 85 cm. However, when the time difference is more than 2 steps per second, it means that the user is walking fast, and the corresponding step distance will be larger, usually about 100 cm. In other words, the faster the walking speed (that is, the shorter the interval between footsteps), the larger the step distance. It should be noted that the step distances described above are calculated based on the walking speed of an ordinary adult, and it can be modified for different ages or different heights and is not limited thereto.

According to an embodiment of the invention, when a difference between the receiving angle "θa1" and "θb1" and a difference between the receiving angle "θa2" and "θb2" is 0 or less than a predetermined value (for example, less than 5 degrees), it means that the user is stepping on the spot without moving, then the processing module 120 determines that the current location of the user is the same as the previous location. Conversely, when the difference between the receiving angle "θa1" and "θb1" and the difference between the receiving angle "θa2" and "θb2" is greater than the predetermined value (that is, greater than 5 degrees), it means that the user is moving, and the processing module 120 can obtain the position corresponding to point "b" according to coordinates of the point "a", the receiving angles "θa1", "θb1", "θa2", "θb2", and the step distance. For example, as shown in FIG. 4*b*, after an angle "θab" is obtained, coordinates of point "b" (Xb, Yb) can be calculated according to the coordinates of the point "a", i.e., (Xa, Xb)=(Xa+Lab*Sin θab, Ya+Lab)*Cos θab). Where "Lab" is the step distance mentioned in the previous paragraph. And so on, when the user walks within the sound collection range of the microphone array 110, the user's movement track can be tracked in the aforementioned manner.

Figure 5:
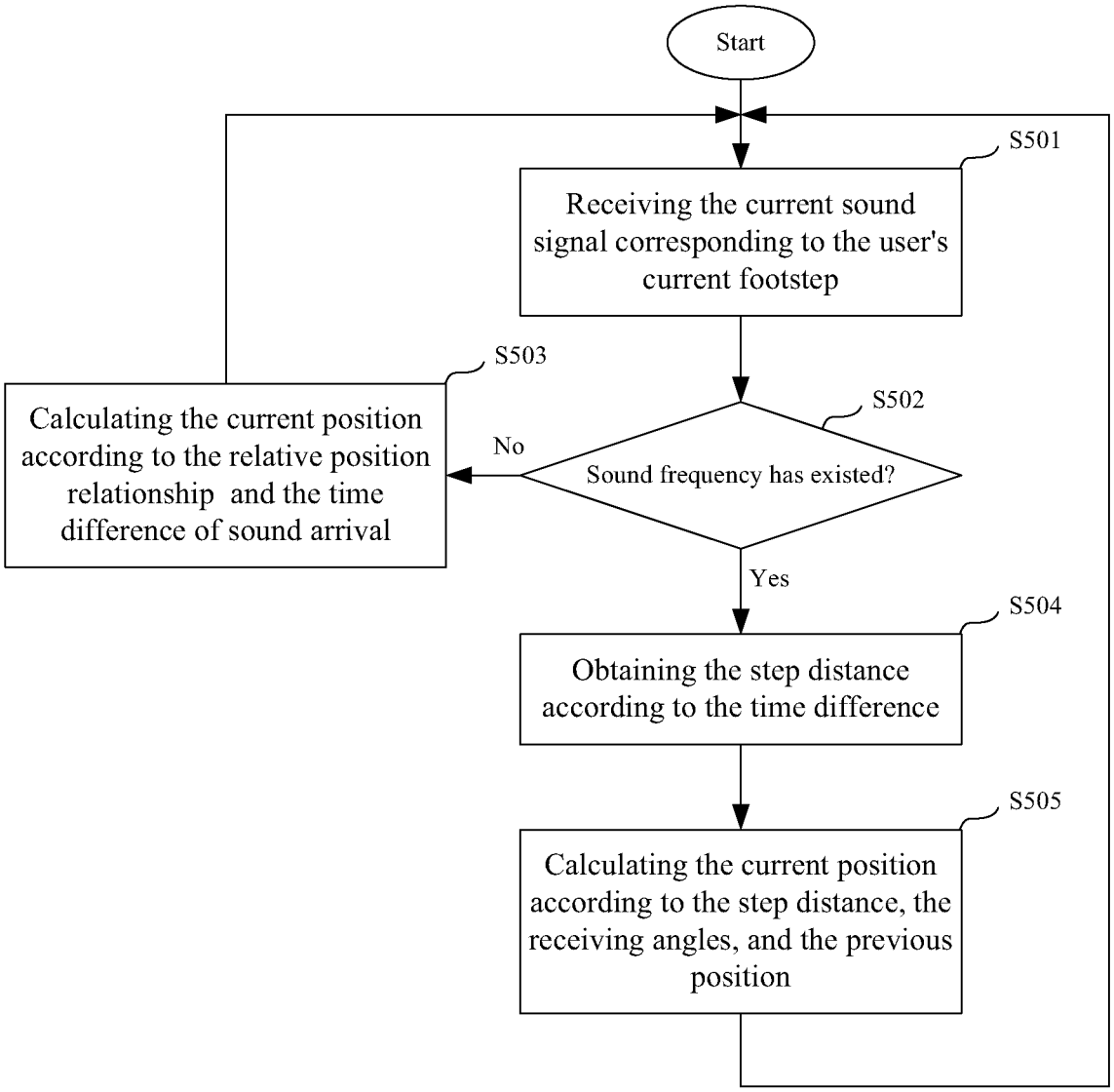
FIG. 5 is a flowchart of a footsteps tracking method in accordance with an embodiment of the invention.

FIG. 5 is a flowchart of a footsteps tracking method in accordance with an embodiment of the invention. In step S501, the microphone array 110 receives the current sound signal corresponding to the user's current footstep, and outputs the corresponding current sound signal to the processing module. In step S502, the processing module 120 analyzes the sound frequency of the sound signal and determines whether the sound signal with the same sound frequency has existed within the predetermined time. If the sound signal with the same sound frequency has not been received within the predetermined time, the method proceeds to step S503, the processing module 120 calculates the current position corresponding to the current footstep of the user according to the relative position relationship of at least three microphones in the microphone array 110 and the time difference of sound arrival of the sound signals received by the three microphones. Conversely, if the microphone array 110 has received a sound signal with the same sound frequency within the predetermined time, the method proceeds to step S504, the processing module 120 obtains the step distance according to the time difference between the current sound signal corresponding to the current footstep and the previous sound signal corresponding to the previous footstep. In step S505, the processing module 120 calculates the current position corresponding to the current footstep according to the step distance, the receiving angles respectively corresponding to at least two microphones in the microphone array 110, and the previous position corresponding to the previous footstep. In addition, when the receiving angles at which the microphones received corresponding to the current footstep is the same as the receiving angle at which the microphones received corresponding to the previous footstep, the processing module 120 determines that the user only steps in place, that is, the current position is the same as the previous position.

It should be noted that although the method as described above has been described through a series of steps or blocks of a flowchart, the process is not limited to any order of the steps, and some steps may be different from the order of the remaining steps or the remaining steps can be done at the same time. In addition, those skilled in the art should understand that the steps shown in the flowchart are not exclusive, other steps may be included, or one or more steps may be deleted without departing from the scope.

In summary, according to the footsteps tracking method and system of the invention, the position corresponding to the user's first footstep can be obtained through the time difference of arrival algorithm, and then the user's movement track can be calculated by monitoring the time difference of the user's subsequent footsteps and the receiving angles corresponding to a pair of microphones. In addition, different users can be distinguished by identifying the sound frequency of the shoes corresponding to the footsteps, and multiple users can be located at the same time without the need for additional sensors, thereby reducing the cost of monitoring.

It will be apparent to those skilled in the art that various modifications and variations can be made to the structure disclosed without departing from the scope or spirit of the claims. In view of the foregoing, it is intended that the present disclosure covers modifications and variations, provided they fall within the scope of the following claims and their equivalents.

What is claimed is:

1. A footsteps tracking method, comprising the steps of:

obtaining a first position corresponding to a user's first footstep;

receiving, by a microphone array, a first sound signal corresponding to the user's first footstep;

receiving, by the microphone array, a second sound signal corresponding to a second footstep of the user, wherein an audio frequency of the second sound signal is the same as an audio frequency of the first sound signal; and calculating, by the processing module, a second position corresponding to the second footstep according to the first position, a time difference between receiving the first sound signal and the second sound signal, receiving angles between the first sound signal and a pair of the three microphones, and receiving angles between the second sound signal and the pair of the three microphones.

2. The footsteps tracking method as claimed in claim 1, wherein the second position is equal to the first position when a difference between the receiving angles corresponding to the first sound signal and the receiving angles corresponding to the second sound signal is equal to 0 or less than a predetermined value.

3. The footsteps tracking method as claimed in claim 1, further comprising:

selecting, by the processing module, different steps according to the time difference between receiving the first sound signal and the second sound signal.

4. The footsteps tracking method as claimed in claim 1, wherein the microphone array has five microphones and is a regular pentagon, and a distance between every two adjacent microphones is 20 mm.

5. A footsteps tracking system, comprising:

a microphone array, comprising at least three microphones configured for receiving a first sound signal corresponding to a user's first footstep and a second sound signal corresponding to the user's second footsteps, wherein the audio frequency of the second sound signal sound signal is the same as the audio frequency of the first sound signal; and a processing module configured for obtaining a first position corresponding to the first footstep, and calculating a second position corresponding to the second footstep according to the first position, a time difference between receiving the first sound signal and the second sound signal, receiving angles between the first sound signal and a pair of the three microphones and receiving angles between the second sound signal and the pair of the three microphones.

6. The footsteps tracking system as claimed in claim 5, wherein the second position is equal to the first position when a difference between the receiving angles corresponding to the first sound signal and the receiving angles corresponding to the second sound signal is equal to 0 or less than a predetermined value.

7. The footsteps tracking system as claimed in claim 5, wherein the processing module further select different steps according to the time difference between receiving the first sound signal and the second sound signal.

8. The footsteps tracking system as claimed in claim 5, wherein the microphone array has five microphones and is a regular pentagon, and a distance between every two adjacent microphones is 20 mm.

* * * * *